United States Patent [19]

Billington, III et al.

[11] Patent Number: 4,763,794

[45] Date of Patent: Aug. 16, 1988

[54] PRODUCE SORTING APPARATUS

[75] Inventors: Charles J. Billington, III, Modesto; Richard K. Oyama, Stockton; Kenneth H. Jepson; Thomas R. Skeen, both of Modesto, all of Calif.

[73] Assignee: Billington Welding and Mfg., Modesto, Calif.

[21] Appl. No.: 892,126

[22] Filed: Jul. 30, 1986

[51] Int. Cl.[4] ..... B07B 5/06

[52] U.S. Cl. ..... 209/625; 209/379; 209/394; 209/676; 209/679

[58] Field of Search ..... 209/625-628, 209/660, 668, 670, 673-679, 379, 384, 393-395, 916, 918, 920

[56] References Cited

U.S. PATENT DOCUMENTS

| | | | |
|---|---|---|---|
| 424,002 | 3/1890 | Jones | 209/625 |
| 431,176 | 7/1890 | Thissell | 209/627 |
| 497,599 | 5/1893 | Pease | 209/676 X |
| 838,402 | 12/1906 | Gunckel . | |
| 1,035,887 | 8/1912 | Maull . | |
| 1,105,427 | 7/1914 | Hellfach | 209/676 |
| 1,189,167 | 6/1916 | Parker | 209/625 |
| 1,310,921 | 7/1919 | Notenboom | 209/627 |
| 1,677,037 | 7/1928 | Leweke | 209/678 |
| 1,832,035 | 11/1931 | Leib . | |
| 1,927,405 | 9/1933 | Johnson . | |
| 2,370,539 | 2/1945 | Hodecker | 209/668 |
| 2,917,171 | 12/1959 | Heald . | |
| 3,108,691 | 10/1963 | Vance . | |
| 3,151,742 | 10/1964 | O'Brien . | |
| 3,211,289 | 10/1965 | Brumagin | 209/674 X |
| 3,770,123 | 11/1973 | Mraz | 209/668 |
| 4,364,479 | 12/1982 | Sardo | 209/668 |

FOREIGN PATENT DOCUMENTS

| | | | |
|---|---|---|---|
| 1115036 | 12/1955 | France | 209/679 |
| 1020958 | 2/1966 | United Kingdom | 209/625 |

*Primary Examiner*—Edward M. Reeves
*Assistant Examiner*—Edward M. Wacyra
*Attorney, Agent, or Firm*—Flehr, Hohbach, Test, Albritton & Herbert

[57] ABSTRACT

An apparatus for sorting produce by size is disclosed. The produce travels over a series of openings (34), ranging from small to large. The produce falls through the openings and is collected beneath them. The openings are adjustable (91) to handle various types and sizes of produce. A plurality of fingers (52) is provided which move from below up into the openings to dislodge any produce jammed in the openings.

16 Claims, 6 Drawing Sheets

PRODUCE SORTING APPARATUS

TECHNICAL FIELD

This invention is generally in the field of sorting produce by size, and more particularly, relates to produce sizing apparatus having various sizing spaces through which produce passes to effect sorting.

BACKGROUND ART

Prior to processing or shipping to market, fresh produce often must be graded or sorted by size. For example, pieces might be sorted into small, medium, and large sizes. Many devices exist to accomplish this sorting. In one type, the produce is fed over openings or spaces of various sizes. If the pieces are smaller than the spaces, they drop through, while larger pieces do not. Generally the produce is advanced over the spaces in order from the smallest to largest spaces, so that the smallest pieces drop out first. The produce may be collected in bins beneath the openings, carried away by conveyor, or removed by some other means.

Often the apparatus consists of a series of parallel rods, rollers, or spindles. The slots between the rods provide the sizing spaces. The produce travels over the rods in the longitudinal direction of the rods and falls through the spaces between the rods. To move the produce over the rods, the rods may be sloped so that the produce travels by gravity. Alternatively or additionally some rods rotate and have a helical rib on their surfaces to advance the produce. An apparatus of this type is shown in the U.S. Pat. No. 3,770,123 to Mraz. A further alternative is to employ apparatus which is vibrated to move the produce along the sizing space defining structure, as in the U.S. Pat. No. 1,927,405 to Johnson. In the U.S. Pat. No. 3,151,742 to O'Brien the produce is carried by a conveyor with only one size of sizing spaces. At one end of the conveyor's loop, a finger belt lifts out the produce that was too large to fall through the sizing spaces in the conveyor.

To provide several sizes of spaces, the sizing rods sometimes diverge, as shown in Johnson. In Mraz, the different sizing spaces are formed by rods that are stepped in diameter.

It has been found that some varieties of produce get stuck or jammed between rods such as those in Mraz or Johnson. This is particularly true of long, thin, twisted produce, such as certain types of peppers. Also, if the produce is dumped in a heap on the apparatus, larger pieces underneath may become jammed between the spacing rods and/or block smaller pieces from the openings.

The spaces between the rods are sometimes adjustable to accommodate different types and sizes of produce. For example, in Mraz, every other rod is adjustable to change the size of the opening. However, in Mraz, the adjustable rod, swung about an axis, does not remain on a level with the fixed roller. This may promote jamming if a piece gets caught underneath the upper roller. In the U.S. Pat. No. 1,832,035 to Leib, the rollers are adjustable horizontally, but each space must be adjusted individually and only when the machine is stopped. In Vance, U.S. Pat. No. 3,108,691, every other rod is laterally adjustable.

DISCLOSURE OF THE INVENTION

Accordingly, it is an object of this invention to provide an apparatus for sorting produce by size in which the produce does not get jammed or stuck in the sorting apparatus.

It is a further object to provide a sorting apparatus in which larger produce will not block the access of smaller produce to the smaller sizing spaces.

A still further object is to provide a sorting apparatus with adjustable sizing spaces to accommodate a variety of produce types and sizes.

Another object is to provide a sorting apparatus in which the size of the sizing spaces can be adjusted during operation.

Still another object is to provide a sorting apparatus in which the adjustment of the sizing spaces does not promote further jamming of the produce.

A further object is to provide a sorting apparatus in which a plurality of sizing spaces can be adjusted simultaneously.

Additionally, it is an object to provide an apparatus ideally suited for sizing long, thin, or twisted produce such as peppers, as well as other fruits, nuts and vegetables.

A further object is to provide a sorting apparatus which is accurate, efficient, and does not harm the produce.

Accordingly, this invention provides a sorting apparatus for sorting produce by size having a main frame, produce sizing means movably mounted on the main frame and having at least one sizing space dimensioned for passage of produce of a selected size, and drive means coupled to the sizing means for displacement of the produce relative to the sizing means to effect sorting. The improvement in the produce sizing apparatus of the present invention comprises, briefly, dislodging means mounted for movement between a first position permitting passage of produce through the sizing space and a second position urging produce lodged in said sizing space back out of said sizing space and onto said sizing means for further sizing. The dislodging means is sufficiently rigid to contact and positively force out any produce lodged in the sizing space during movement from the first position to the second position, yet flexible enough not to bruise the produce. A plurality of fingers on the dislodging means contacts the produce. A dislodgement drive means is coupled to cycle the dislodging means between the first and second positions.

The produce sizing means includes pairs of rods each having a first rod and a second rod defining a sizing space therebetween. An adjustment means is provided for moving the rods of the sizing means to adjust the size of the sizing space. The adjustment means includes an eccentric mounting means for mounting the rods for lateral movement with respect to the other rods when the mounting means is rotated. A coupling means, comprising an intermeshing gear means, couples rods together for movement.

Other objects and advantages of the present invention will become apparent from and are set forth in more detail in the accompanying drawings and following description of the best mode for carrying out the invention.

BEST MODE FOR CARRYING OUT THE INVENTION

Figure 1A:
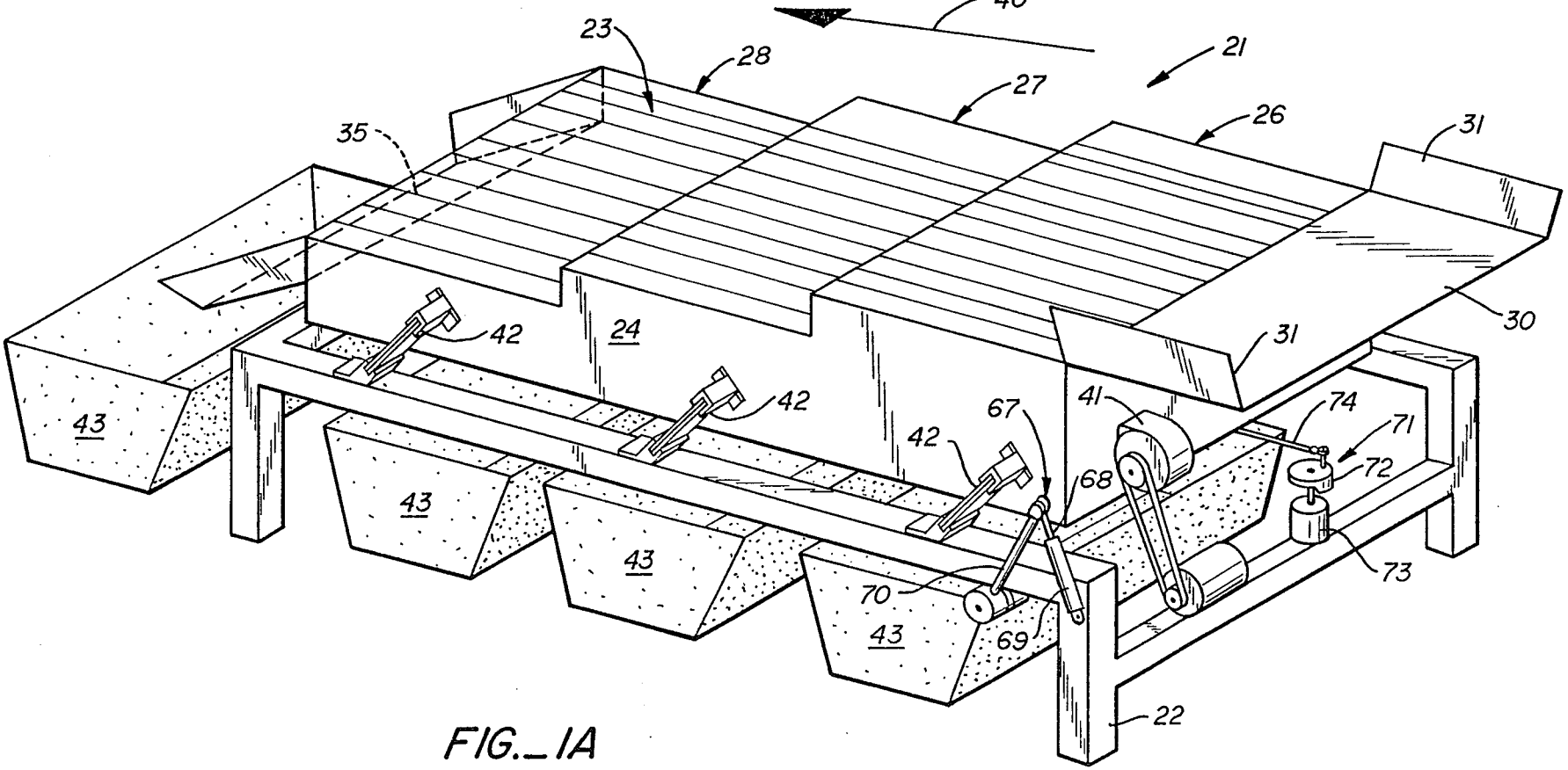
FIG. 1A is a rear perspective view of the sorting apparatus of this invention with parts removed for clarity.
Figure 1B:
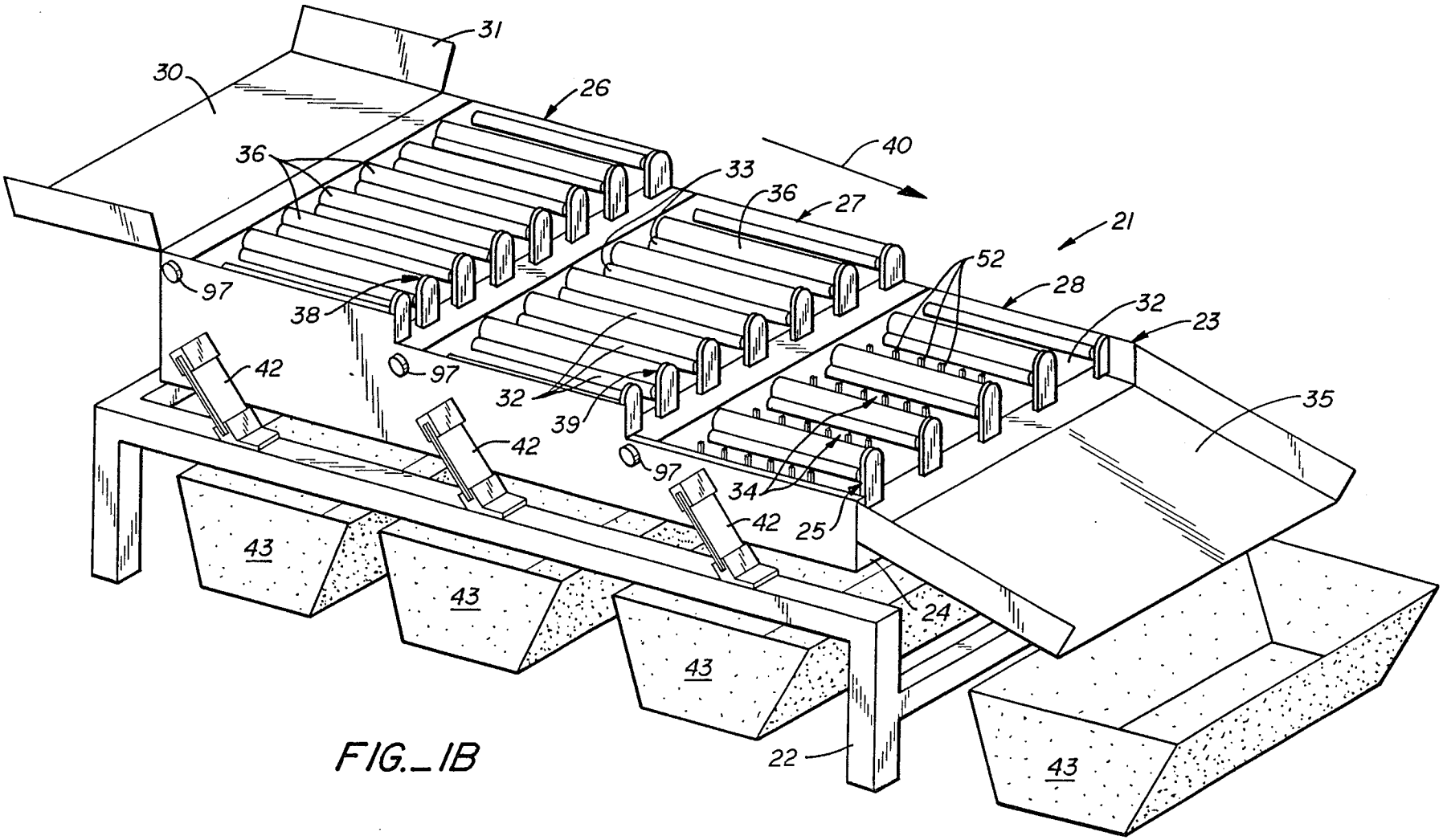
FIG. 1B is a front perspective view of the sorting apparatus of this invention.

FIGS. 1A and 1B show a sorting apparatus generally designated 21 of the present invention. The apparatus has a main frame 22 and a produce sizing means generally designated 23 which is carried by a frame 24. In FIG. 1A, the produce sizing means has been removed for clarity. Within sizing means frame 24 are a plurality of banks, each bank being formed for sorting out a different size of produce. FIGS. 1A and 1B shows three banks, 26, 27, 28, but any appropriate number can be used depending upon the produce being sorted. While banks 26–28 are shown as mounted to common frame 24, alternatively, each bank could be separately mounted and carried by its own individual frame.

Figure 2:
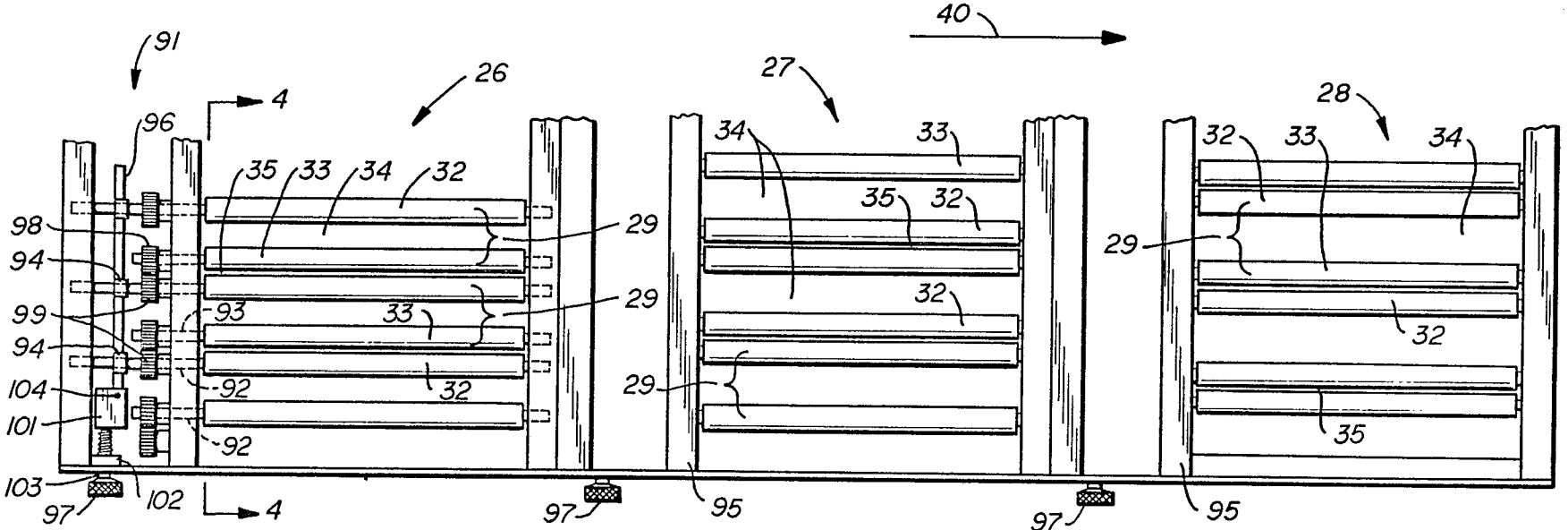
FIG. 2 is a top plan view of the sorting apparatus of FIG. 1 with parts cut away for clarity.
Figure 3:
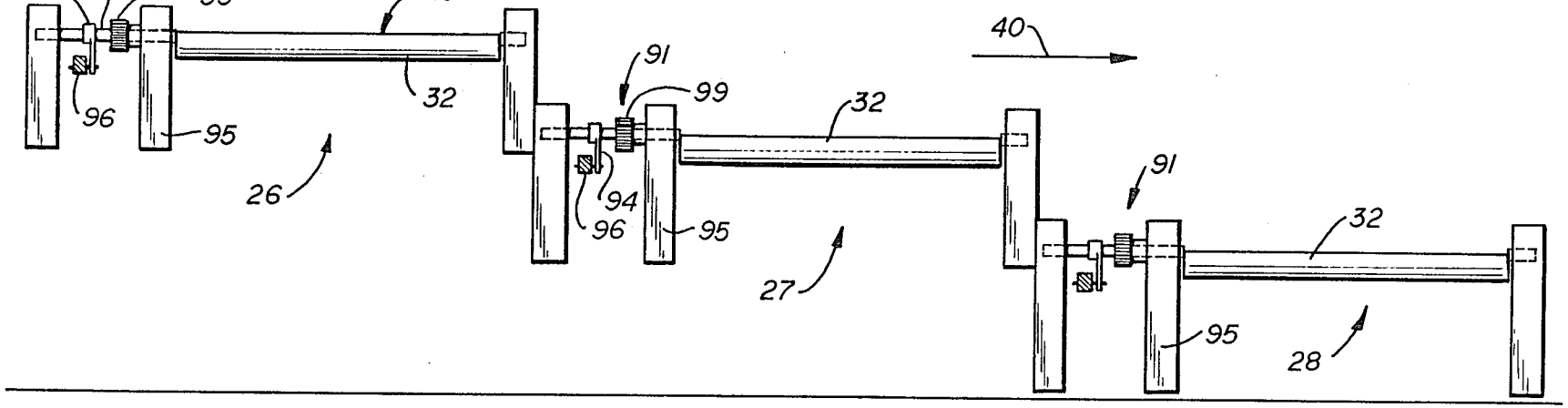
FIG. 3 is a side elevation view of the sorting apparatus of FIG. 1 with parts removed for clarity.
Figure 4:
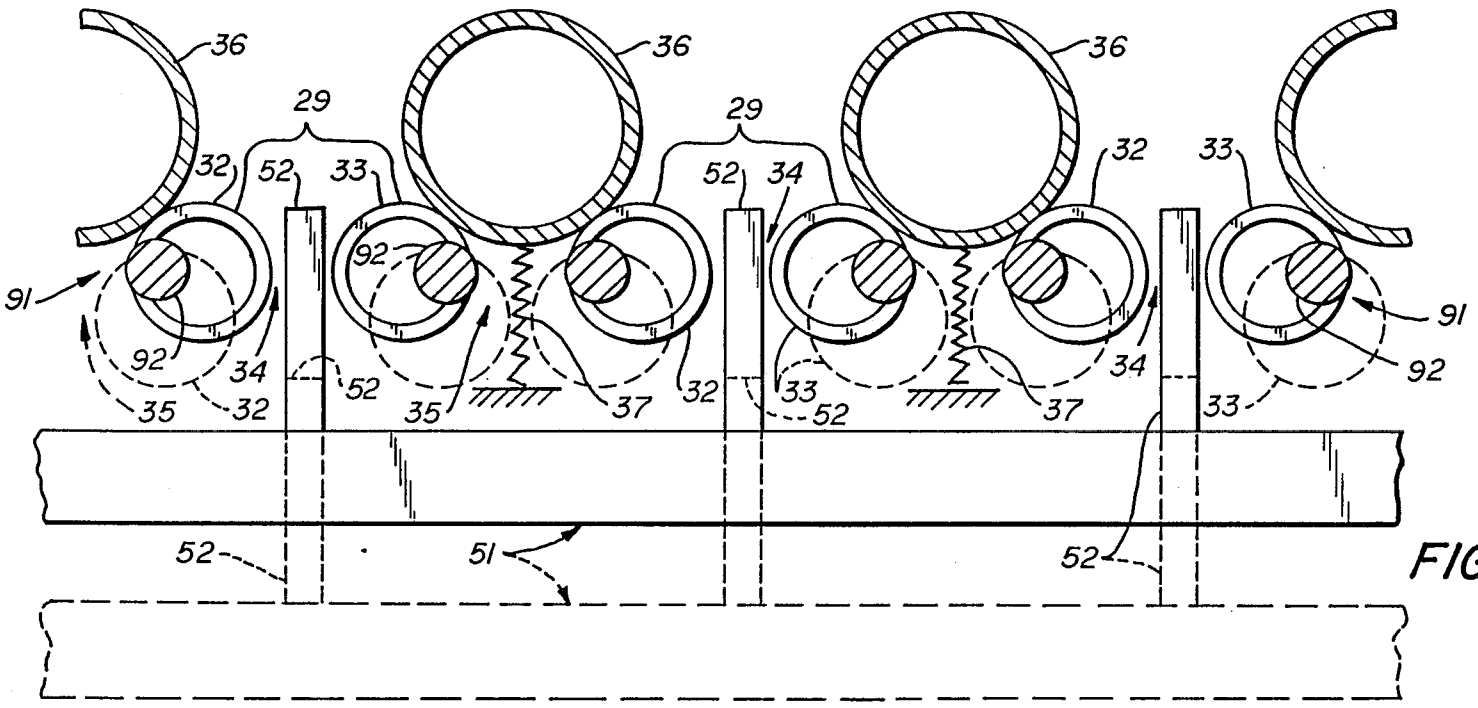
FIG. 4 is a fragmentary, enlarged, sectional view taken substantially along the plane of line 4—4 of FIG. 2.

Within each bank 26–28 are a plurality of pairs of rods or cylindrical members 29. These pairs are best seen in FIGS. 2 and 4. Each pair 29 comprises a first rod 32 and a second rod 33. A sizing space 34 is formed by the slot between first rod 32 and second rod 33 of each pair 29.

A produce guiding means 36 is formed to cover the space 35 between adjacent pairs 29 of rods and to guide the produce into sizing space 34 between rods 32 and 33 of each pair. This guiding means preferably is provided by a cylindrical member which is urged downwardly into contact with rods 32,33 by an urging means 37, such as a spring (FIG. 4).

The produce is moved along the sizing means primarily by vibration. Sizing means 23 is vibrated by vibrator 41 (FIG. 1A) which imparts a shaking motion to sizing means frame 24. The sizing means frame is mounted on flexible fiberglass supports 42 attached to main frame 22. These supports are mounted at an angle between main frame 22 and sizing means frame 24, thus forming a parallelogram. The sizing means moves primarily in the longitudinal direction of rods 32, 33, as indicated by arrow 40, with the motion remaining parallel to the main frame. This vibration causes the produce to travel longitudinally over the rods of the sizing means. Since relatively little downward motion is imparted to the produce, it is not significantly harmed by forceful contact with the sizing means. The rods also may be sloped in the direction of arrow 40 to aid the produce in its travel.

The produce is first placed on loading tray 30 shown in FIG. 1A. Once on the tray, the vibrations from vibrator 41 will begin to spread out the produce. Side walls 31 keep the produce from falling off loading tray 30 and guide it onto bank 26. Rods 32, 33 of this bank are spaced most closely together to provide the smallest sizing space 34. Therefore, only the smallest size of produce will fall through these spaces. Next the produce travels over end support structure 38 of bank 26 to bank 27, which has a slightly larger size of space 34 between rods 32,33. Produce of a medium size will fall through these spaces. Then the produce travels over end structure 39 of bank 27 to sizing rods 32, 33 of bank 28. The spaces 34 here are larger, so larger sizes of produce fall through. The largest size of produce travels over end structure 25 of bank 28 onto chute 35. The produce may be collected in bins 43 underneath each bank and at the end of main frame 22, carried away by conveyors, or removed by any other means known in the art.

Produce may become lodged in sizing spaces 34. The sorting apparatus includes a dislodging means 51, as shown in FIG. 4, to dislodge any produce that has become jammed between rods 32, 33 and to keep produce moving along sizing means 23. This dislodging means is well suited for dislodging long, thin, or twisted produce such as pepper, but it may also be used to dislodge other fruits, nuts, and vegetables.

Figure 9:
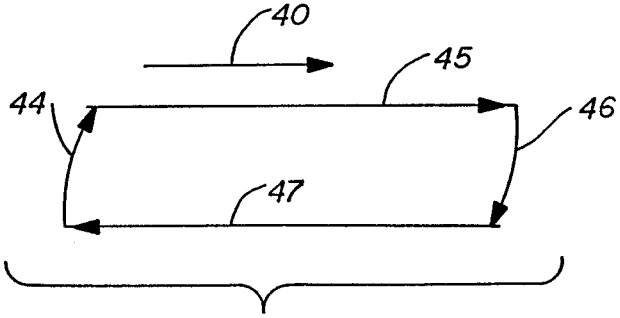
FIG. 9 is a schematic representation of the motion of the produce dislodging fingers by the drive assemblies of FIGS. 7 and 8.

To contact the produce, dislodging means 51 includes a plurality of fingers 52 which project up into sizing spaces 34 from below. Fingers 52 are movable horizontally and vertically by drive means that is set forth in more detail hereinafter. They are first moved up, as indicated by arrow 44 in FIG. 9, so that they project just above the sizing space 34, proximate the tops of rods 32, 33. By this motion, they positively contact any produce in the space, pushing it up and out of the sizing space and onto the sizing means for further sizing. The fingers are next moved horizontally and longitudinally along sizing space 34 and parallel to rods 32, 33 as indicated by arrow 45 in FIG. 9. By this motion, the fingers help the produce move along the sizing means. This movement also mixes the produce up slightly, so that any larger pieces that might be underneath any smaller pieces are jostled out of the way, allowing the smaller pieces to reach the sizing spaces and fall through. Additionally, horizontal displacement of fingers 52 dislodges produce downstream of the position at which the fingers were displaced up into sizing space 34. The fingers are then moved back down out of the sizing space, as indicated by arrow 46, and thereafter horizontally back to their initial position (arrow 47). They have completed a substantially rectangular cycle as shown by FIG. 9. The fingers generally travel about 2 or 3 inches vertically and 5 or 6 inches horizontally. This cycle is repeated at a rate of 350 to 600 cycles per minute.

Fingers 52 preferably are made of ultra high molecular weight polyethylene. They are sufficiently rigid to force any produce out of the sizing spaces, yet flexible enough not to damage the produce. The flexibility of fingers 52 will vary with the nature of the produce being sorted.

Figure 7:
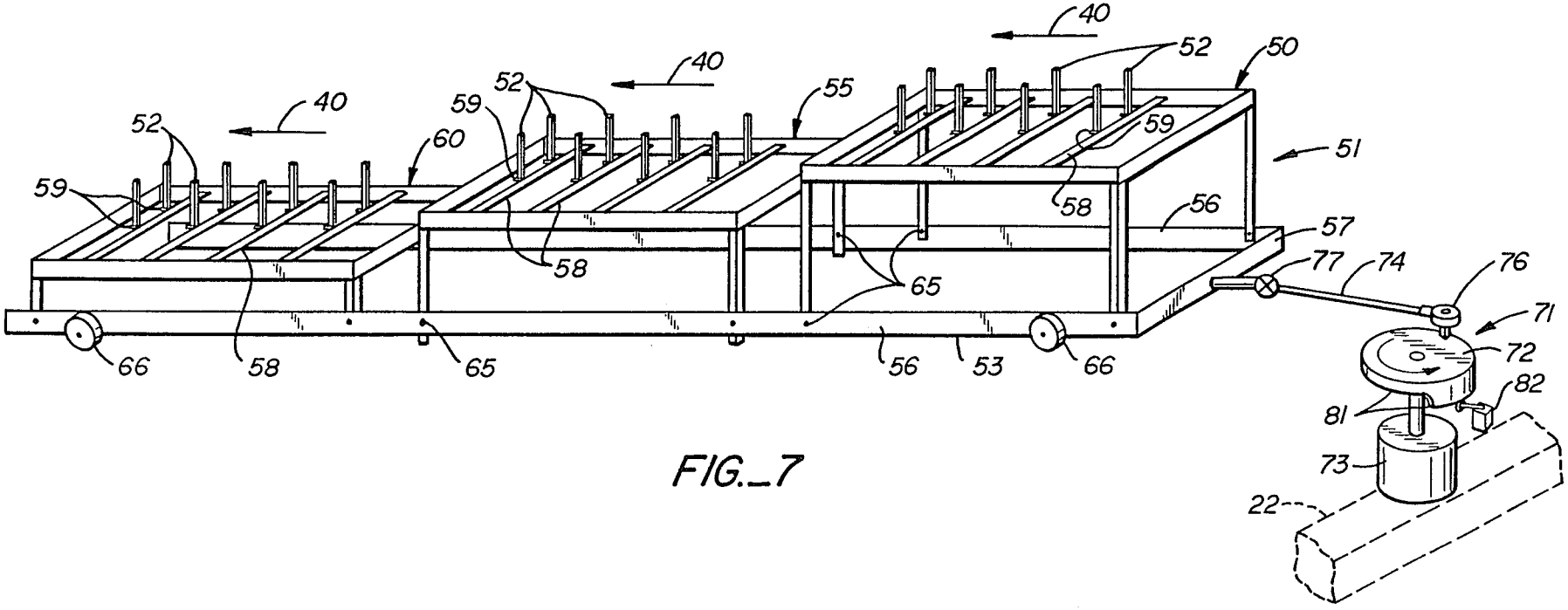
FIG. 7 is a top perspective view of the horizontal motion drive assembly for the produce dislodging fingers of the sorting apparatus of FIG. 1.
Figure 8:
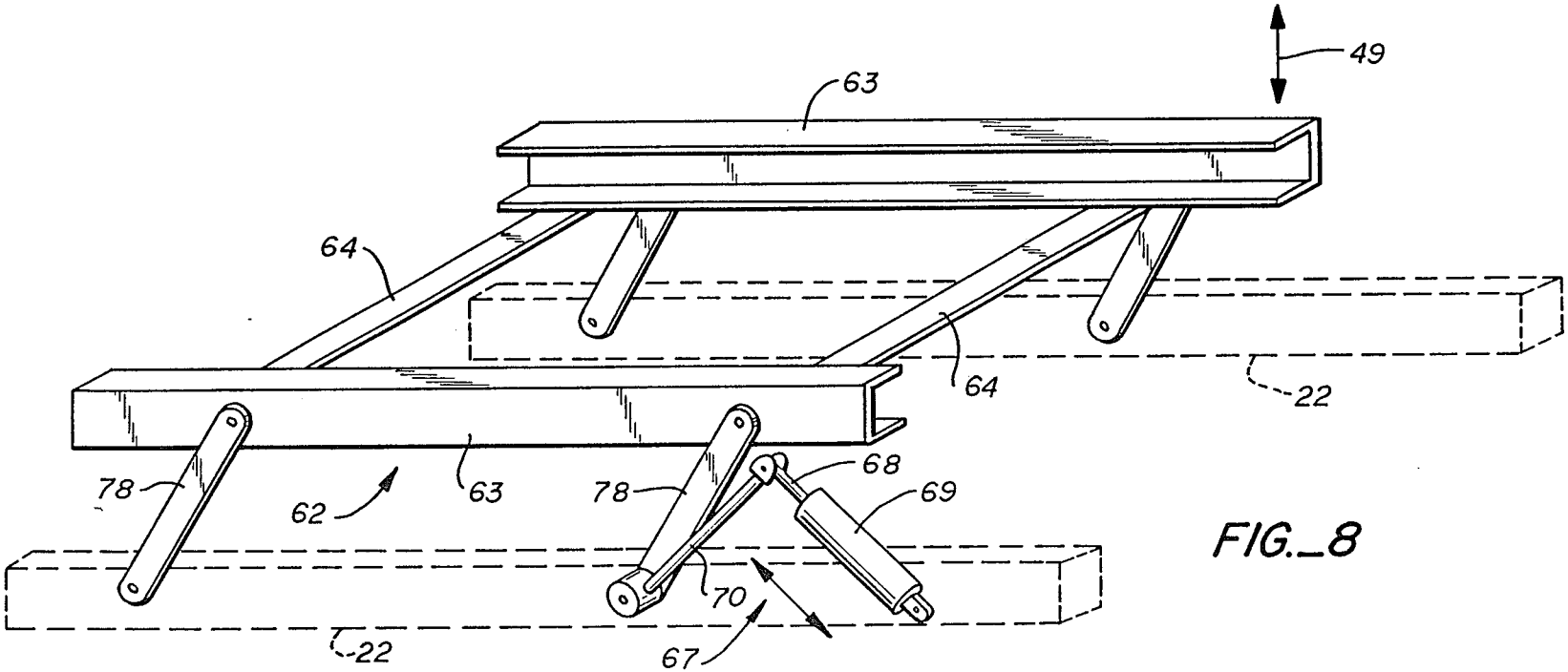
FIG. 8 is a top perspective view of the vertical motion drive assembly for the produce dislodging fingers of the sorting apparatus of FIG. 1.

In order to drive fingers 52 along the rectangular path of FIG. 9, fingers 52 are carried on a horizontally movable carriage 53. See FIG. 7. The carriage is mounted for horizontal movement (arrow 40) on a base 62 (partially shown in phantom in FIG. 7 and shown more completely in FIG. 8). Base 62 is in turn mounted for vertical movement with respect to main frame 22 of the sorting apparatus. Both carriage 53 and base 62 extend substantially the length of sizing means frame 24, although separate carriages and bases could be provided for each bank 26–28.

Figure 6:
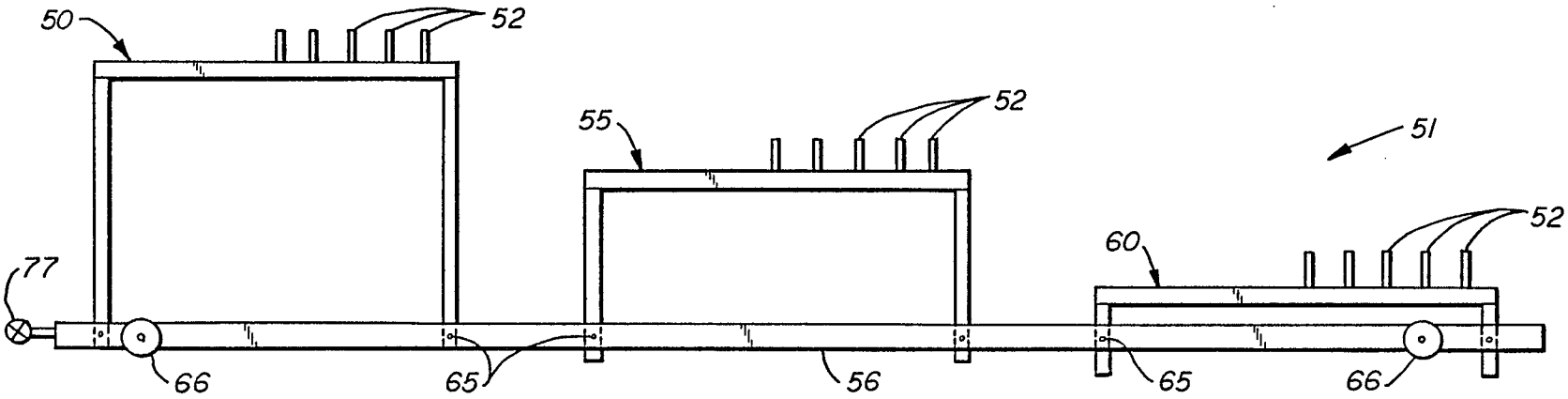
FIG. 6 is a side elevation view of the dislodging means of the sorting apparatus of FIG. 1.
Figure 7A:
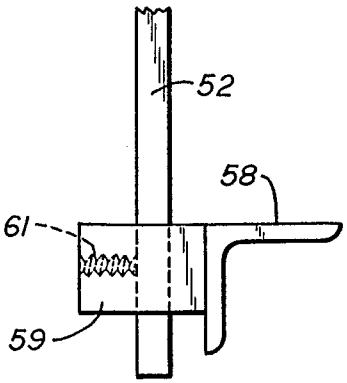
FIG. 7A is a fragmentary side elevation view of the finger holding assembly.

Fingers 52 are vertically adjustable within carriage 53 to bring the fingers into proper vertical position within sizing spaces 34. Carriage 53 comprises two longitudinal members 56 connected at their ends by two crosspieces 57 to form a rectangular frame. Several finger racks 50, 55, and 60, shown in FIG. 6, are mounted within this rectangular frame, each rack corresponding to a bank 26, 27, 28 of sizing means 23. Racks 50, 55, 60 are individually vertically adjustable within carriage 53 by means of bolts 65. Each rack has several intermediate crosspieces 58 extending transversely across the racks. These intermediate crosspieces are generally L-shaped members. Finger holders 59 are attached to these crosspieces 58 at various locations along the crosspiece (FIG. 7A). Fingers 52 are carried on these finger holders 59 and the height of the fingers can be adjusted by set screw 61. When the carriage is in place beneath the sizing spaces, the crosspieces are perpendicular to rods 32, 33 and elongated sizing spaces 34. The locations of the finger holders and fingers are such that the fingers coincide with the sizing spaces between the rods.

Carriage 53 is mounted for horizontal movement (arrow 40) to base 62. The base comprises two longitudinal channel members 63 mounted so the channels face each other. The channel members are connected by crosspieces 64. See FIG. 8. The carriage includes wheels 66 or lugs which roll or slide inside channel members 63.

Base 62 is mounted for vertical movement (arrow 49) to main frame 22 of the sorting apparatus. A raising and lowering means, generally designated 67, is formed so that one end is attached to main frame 22 and the other end is coupled to drive base 62. This raising and lowering means is preferably a pneumatic piston 68 and cylinder 69. Piston 69 is coupled to crank arm 70 which in turn rotates links 78 to effect vertical displacement of base 62, carriage 53 and fingers 52. As will be appreciated, other suitable means can be used to produce vertical displacement.

The horizontal motion is preferably imparted to the carriage by an eccentric assembly 71. See FIGS. 1A and 7. A disk or plate 72 is mounted on main frame 22 for rotation about a vertical axis. The disk is rotated by a motor 73, and shaft 74 is eccentrically mounted at joints 76 to the disk 72 so that one end of the shaft is constrained to rotate in a horizontal plane as disk 72 rotates. The other end of shaft 74 is attached by joint 77 to carriage 53. Joint 77 is constrained to move in a vertical plane so that it will impart only horizontal movement, parallel to the rods 32, 33, to carriage 53. Shaft 74 is connected to the disk 72 and carriage 53 to allow pivoting of the shaft in a vertical plane so that the shaft can also follow the vertical movement of the carriage.

The disk also has a cam surface 81. This surface engages a switch 82 which actuates raising and lowering means 67. This switch may be pneumatic or an air logic switch.

With each rotation of disk 72, carriage 53 completes one horizontal cycle. Also during one rotation of the disk, cam surface 81 first engages switch 82 to actuate raising and lowering means 67 to raise base 62 and then disengages switch 82 to lower the base. Thus, the horizontal and vertical motions are coupled to occur in one cycle, as shown in FIG. 9.

In order to enable variation of the sizing spaces to facilitate sorting of different types and sizes of produce, rods 32, 33 preferably are laterally adjustable to vary the dimension of spaces 34. Each rod is eccentrically mounted for rotational movement to an eccentric mounting means 91 (FIGS. 2–6). The eccentric mounting means includes a driven bar 92 rotatably carried on the sizing means frame member 95. The end of each rod 32 is attached, for example by welding, to bar 92, while the end of each bar 33 is attached to idler bar 93. When bar 92 is rotated, attached rod 32 is also rotated, as shown by the dotted lines in FIG. 4.

Figure 5:
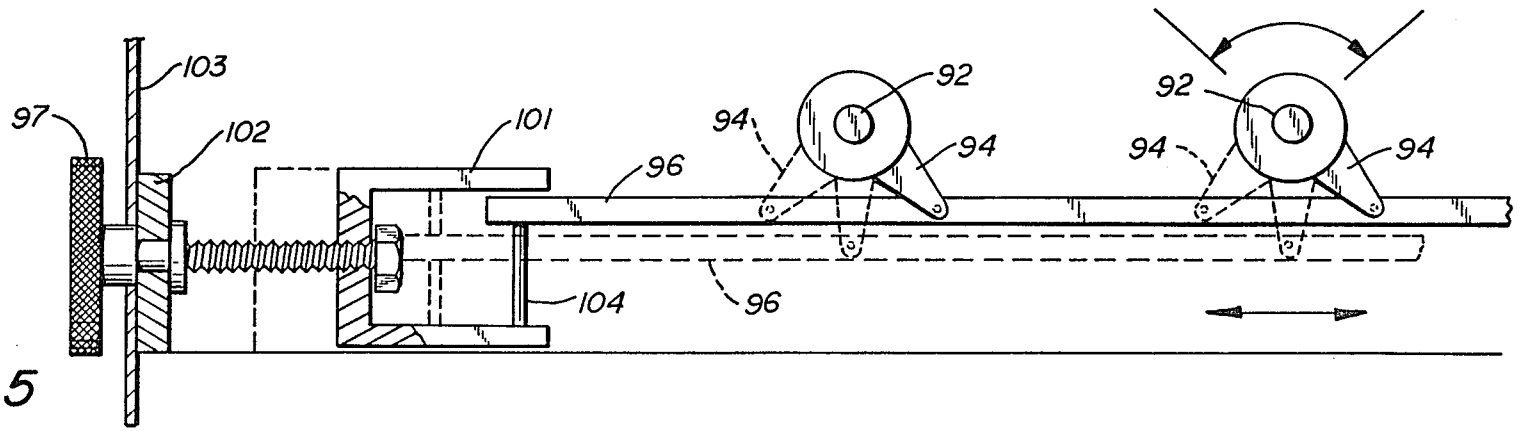
FIG. 5 is an enlarged end elevation view showing a detail of the sizing space adjustment means.

In the preferred form, bars 92 are driven directly, while idler bars 93 are provided with gears 98 which intermesh with gears 99 on driven bars 92. As seen in FIG. 5, levers 94 are fixed on driven bars 92 and pivotally engage bar 96 that extends the width of the sizing means. One end of bar 96 is attached to clevis 101 so that bar 96 can move vertically in the clevis. Handle 97 projects from sizing means 23 and is rotatably mounted in bearing 102 in sizing means frame member 103. Rotation of handle 97 imparts a horizontal translation to clevis 101. The clevis in turn moves bar 96 horizontally, and, to accommodate pivoting of levers 94, bar 96 also moves vertically on pin 104 in clevis 101. Pivoting of levers 94 rotates driven bars 92, which rotates first rods 32 attached to driven bars 92. To rotate second rods 33, gears 98 are provided on idler bars 93, so that first rod 32 of one pair 29 of rods is coupled to second rod 33 of an adjacent pair 29 of rods. In this manner, the second rod 33 of each pair can be turned. See FIG. 2. Other mechanisms known in the art can be used to rotate bars 92.

The rods are adjusted so that they always move laterally with respect to the other rods, as seen in FIG. 4. This way, the rods are always on the same level, lessening the chance of produce getting jammed underneath. Also, the centerline of the sizing space will always remain the same. This is advantageous when a dislodging means 51 is located below or in the sizing space 34, since it is preferable that the fingers 52 be always on the centerline, regardless of the adjustment of the space.

INDUSTRIAL APPLICABILITY

The present sorting apparatus is used in the field of sorting produce by size prior to processing or sending it to market. The produce is fed over a bed with a series of openings of different sizes. The produce encounters the openings in order from smallest to largest. Pieces smaller than the openings fall through and are collected beneath. Any pieces lodged in the sizing spaces are dislodged by the dislodging means to prevent jamming of the sizing slots.

What is claimed is:

1. In a sorting apparatus for sorting produce by size having a main frame, produce sizing means movably mounted on said main frame and defining at least one sizing space dimensioned for passage of produce of a selected size therethrough, and drive means coupled to said sizing means for displacement of said produce relative to said sizing means to effect sorting, the improvement comprising:

dislodging means mounted for movement between a first position permitting passage of produce of said selected size through said sizing space and a second position urging produce lodged in said sizing space back out of said sizing space and onto said sizing means for further sizing, said dislodging means including a base mounted for vertical movement with respect to said main frame a carriage, and a plurality of fingers carried by said carriage, said dislodging means being sufficiently rigid to contact and positively force said produce lodged in said sizing space therefrom during movement from said first position to said second position; and dislodgement drive means coupled to cycle said dislodging means between said first position and said second position.

2. A sorting apparatus as in claim 1 wherein, said fingers are formed to contact said produce.

3. A sorting apparatus as in claim 2 wherein, said sizing means defines a plurality of elongated slots providing said sizing space and said fingers are spaced along said slots.

4. A sorting apparatus as in claim 3 wherein, said fingers are mounted for movement from said first position below said slots to said second position protruding into said slots and for movement longitudinally along said slots while in said second position.

5. A sorting apparatus as in claim 4 wherein, said sizing means includes a plurality of rods, said rods defining said elongated slots, and the tops of said fingers are proximate the tops of said rods when said dislodging means is in said second position.

6. A sorting apparatus as in claim 5 wherein, said fingers are flexible.

7. A sorting apparatus as in claim 1 wherein, said dislodgement drive means first moves said dislodging means from an initial position below said sizing space to above said sizing space, then moves said dislodging means horizontally in a first direction while above said sizing space, then moves said dislodging means below said sizing space, then moves said dislodging means horizontally in a second direction opposite to said first direction to said initial position.

8. A sorting apparatus as in claim 1 wherein, said carriage is mounted for horizontal movement with respect to said base.

9. A sorting apparatus as in claim 8 wherein, said dislodgement drive means includes a motor, a disk rotatably driven by said motor, and a shaft having a first end eccentrically mounted to said disk and constrained to move in a horizontal plane and having an opposite end constrained to move in a vertical plane, and said opposite end is attached to said carriage to move said carriage horizontally.

10. A sorting apparatus as in claim 8 wherein, said carriage includes at least one rack mounted for vertical adjustment, and said fingers are carried by said rack.

11. A sorting apparatus as in claim 8 wherein, said dislodgement drive means includes a raising and lowering means to vertically move said dislodging means having a first end attached to said main frame and an opposite end attached to said base, a switch means to actuate said raising and lowering means, a motor, a disk rotatably driven by said motor, a shaft having a first end eccentrically mounted to said disk and constrained to move in a horizontal plane and having an opposite end constrained to move in a vertical plane, said opposite end of said shaft is attached to said carriage to move said dislodging means horizontally, and said disk includes a cam surface engageable with said switch means to cause said switch means to actuate said raising and lowering means.

12. In a sorting apparatus for sorting produce by size having a main frame, produce sizing means movably mounted on said main frame and defining at least one sizing space dimensioned for passage of produce of a selected size therethrough, and drive means coupled to said sizing means for displacement of said produce relative to said sizing means to effect sorting, the improvement comprising:

dislodging means mounted for movement between a first position permitting passage of produce of said selected size through said sizing space and a second position urging produce lodged in said sizing space back out of said sizing space and onto said sizing means for further sizing, said dislodging means being sufficiently rigid to contact and positively force said produce lodged in said sizing space therefrom during movement from said first position to said second position; and dislodgement drive means coupled to cycle said dislodging means between said first position and said second position, said dislodgement drive means including a raising and lowering means to vertically move said dislodging means having a first end attached to said main frame and an opposite end attached to said dislodging means; and a switch means to actuate said raising and lowering means.

13. A sorting apparatus as in claim 12 wherein, said raising and lowering means is a pneumatic piston and cylinder assembly, and said switch means is an air logic switch.

14. In a sorting apparatus for sorting produce by size having a main frame, produce sizing means including a plurality of pairs of rods, each said pair of rods having a first rod and a second rod defining at least one sizing space therebetween, adjustment means for moving said first rod and said second rod of said pairs of rods to adjust the size of said sizing space, and drive means coupled to said sizing means for displacement of said produce relative to said sizing means to effect sorting, the improvement comprising:

said adjustment means including coupling means for coupling adjacent pairs of said pairs of rods together so that movement of said first rod by said mounting means moves said second rod of an adjacent pair of said pairs of rods and eccentric mounting means mounting at least one of said rods for movement laterally with respect to a remainder of said rods upon rotation of said mounting means to enable variation of the lateral dimension of said sizing space;

said sizing means including produce guide means between said first rod and said second rod of adjacent pairs of rods to guide said produce into said sizing spaces, said produce guide means urged into contact with said first rod and said second rod of said adjacent pairs of rods.

15. A sorting apparatus as in claim 14 wherein, said first and second rods are eccentrically mounted for rotation about an axis parallel to the longitudinal axis of said first and second rods.

16. A sorting apparatus as in claim 14 wherein, said coupling means comprises intermeshing gear means mounted on said eccentric mounting means.

* * * * *